US005097880A

United States Patent [19]

Pousette

[11] Patent Number: 5,097,880

[45] Date of Patent: Mar. 24, 1992

[54] ROTARY LOG DEBARKER WITH IMPROVED AIR MANAGEMENT SYSTEM

[75] Inventor: Ronald D. Pousette, Vancouver, Canada

[73] Assignee: Valon Kone Brunette, Ltd., Canada

[21] Appl. No.: 691,697

[22] Filed: Apr. 26, 1991

[51] Int. Cl.[5] ..... B27L 1/00; F01B 19/04

[52] U.S. Cl. ..... 144/208 E; 92/90; 92/92; 144/208 R; 144/341

[58] Field of Search ..... 144/208 R, 208 E, 340, 144/341; 92/90, 92, 89, 91, 165 R, 167

[56] References Cited

U.S. PATENT DOCUMENTS 3,361,168 1/1968 Brown .
4,122,877 10/1978 Smith et al. ..... 144/208 E
4,566,371 1/1986 Jorgensen et al. ..... 144/208 E
4,830,072 5/1989 Pousette .

*Primary Examiner*—W. Donald Bray
*Attorney, Agent, or Firm*—Kolisch, Hartwell, Dickinson, McCormack & Heuser

[57] ABSTRACT

An air-seal, air-cell rotary-ring-type log debarker which is capable of operating in two different operating modes. In one operating mode, the air seal is nonpressurized, and debarking tools in the debarker are under the actuation control solely of pressure-isolated charged air cells which are carried on the rotary ring in the debarker. In another operating mode, the seal between the rotor and stator is pressurized to allow fluid communication between the two, and tool actuation is under the combined control of the ring-carried air cells and of an external source of selectively variable fluid pressure.

4 Claims, 1 Drawing Sheet

ROTARY LOG DEBARKER WITH IMPROVED AIR MANAGEMENT SYSTEM

BACKGROUND AND SUMMARY OF THE INVENTION

The present invention relates to a rotary-ring-type log debarker, and more particularly, to a unique ring-type debarker which combines the advantages of both air-seal and air-cell conventional machines, without also exhibiting the disadvantages of either.

Known in the rotary-ring debarking art today are machines which are known as air-seal machines and those which are referred to as air-cell machines. Each offers the user distinct advantages, and each also presents the user with distinct disadvantages.

An air-seal machine is one in which the pressure-fluid path, so-to-speak, between the stator and rotor (ring) in the machine is sealed at the rotary interface between the two with the seal being pressurized under normal debarking operations. Such machines typically carry pressure-fluid cylinders, typically air cylinders, on their respective rotors, which cylinders are drivingly connected for actuation of the debarking tools. An important advantage of an air-seal machine is that debarking contact pressure can easily be changed on the fly simply through adjusting the pressure level of the supplied pressure fluid. In addition, the tools can be shifted to their open conditions also at will on the fly. However, a disadvantage of such machines is that considerable seal wear occurs during normal pressurized operation, and this has dictated an operating practice in the past to limit somewhat the maximum rotary speed of the rotor, thus to extend usable seal life. Naturally, since workpiece throughput is somewhat directly related to rotary ring speed, capping the maximum speed also caps potential additional throughput capacity.

Air-cell machines utilize, typically, inflatable/deflatable air bags (or cells) carried on a rotor, which bags are drivingly connected for actuation of the debarking tools. Air bags, when compared with air cylinders, are considerably lighter, and thus offer reduced-inertia operating advantages over air-cylinder (air-seal) debarkers. In addition, it is typical that air cells are inflated to a desired operating condition through a pressure-fluid supply system that does not include (and does not require) an air-seal interposed a rotor and stator in a machine. As a consequence, air-cell machines can typically be operated at much higher speeds since no seal wear is involved, and accordingly can offer some significant throughput advantages. However, air-cell machines cannot have their operating pressures changed on the fly, nor can their tools be opened on the fly. Rather, an air-cell machine must typically be stopped before an adjustment can be made in cell-operating pressure—an obvious disadvantage.

Proposed according to the present invention is a unique rotary-ring-type log debarker which combines the advantages of both air-seal and air-cell machines, while avoiding the drawbacks of both.

This important objective which is offered by the invention is achieved in a rotary-ring-type debarker which includes an air seal through which pressure fluid is supplied via a pilot-check-like valve to air cells which are drivingly connected to the debarking tools. In this machine, the seal between the rotor and the stator is pressurized only during times that an adjustment is being made in air-cell pressure. During a normal debarking operation, the seal is depressurized, and pressure is maintained in the cells through the check valve mentioned. Accordingly, the proposed new machine is capable of operating at the high rotational speeds offered by conventional air-cell machines. In addition, the proposed machine offers the inertial advantages resulting from reduced weight in the ring-carried air cells.

Operating pressure within the cells can be changed on the fly, and the tools can be opened at will on the fly, simply by repressurizing the rotary seal, and making an appropriate adjustment in pressure-fluid source pressure. The seal in such a machine offers extremely extended useful like inasmuch as it is only subjected to wear during the brief intervals when pressure adjustments are being made in the air cells.

These and other objects and advantages which are attained by the invention will become more fully apparent as the description that now follows is read in conjunction with the accompanying drawings.

DETAILED DESCRIPTION OF THE DRAWINGS

DETAILED DESCRIPTION AND BEST MODE FOR CARRYING OUT THE INVENTION

Figure 1:
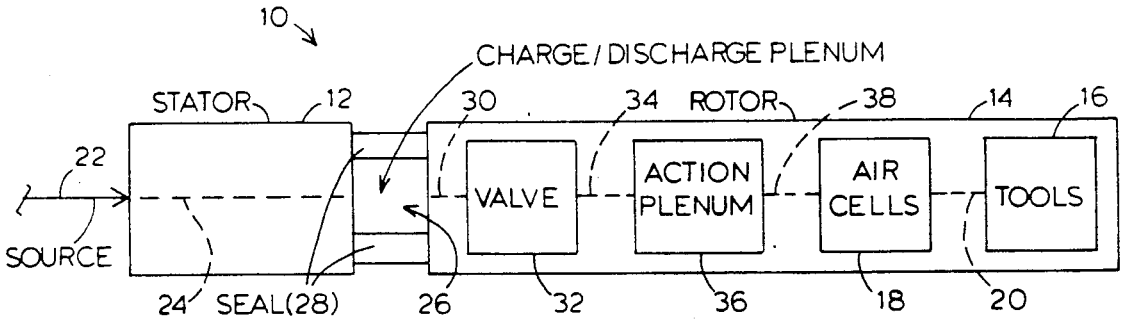
FIG. 1 is a simplified block/schematic diagram illustrating key components in the overall apparatus of the invention.
Figure 2:
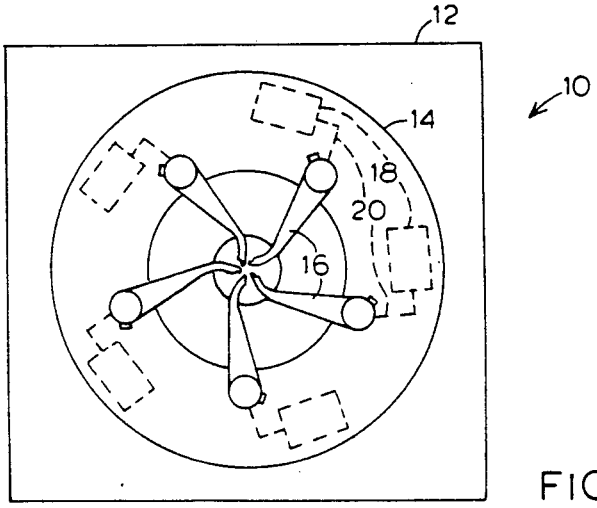
FIG. 2 is a simplified, log-transport-axial view of a rotary-ring log debarker incorporating the apparatus of FIG. 1.

Turning now to the drawings, and referring initially to FIGS. 1 and 2 together, indicated generally at 10 is a rotary-ring-type log debarker which is constructed in accordance with the present invention. Debarker 10 includes the usual stator 12 on which is rotatably mounted a rotary ring, or rotor, 14. Ring 14 herein is shown carrying five pivotally mounted, conventional log-debarking tools, such as tools 16, which are swingable toward and away from the rotary axis of the machine under the influence of air cells, such as cells 18, which are suitably mounted on ring 14 and drivingly connected (on a one-to-one basis) to the tools through appropriate driving linkages, such as linkages 20. Air cells 18 are also referred to herein as inflatable/deflatable pressure-fluid-operated motor means. In FIG. 2, which is a rotary-axis, or log-transport-axis, view, tools 16 are shown in what are known as closed conditions.

The structure which has just been mentioned, insofar as it has been described, is entirely conventional in construction. More particularly, the stator and rotor, per se, within the debarker are conventional, the tools are conventional and are conventionally mounted on the ring, the air cells and their mountings are conventional and are similar to what one would find in examining the same features in a known type air-cell machine, and the driving linkages established between the cells and the tools are conventional.

Strikingly distinguishing debarker 10, however, from conventional construction is that, in addition to having and utilizing air cells for actuating the debarding tools, the machine also includes a rotary seal which acts herein within a pressure-fluid supply structure which is operatively interposed the cells and a suitable external source of pressure fluid, such as air. The operational linkage which exists between such a source and the tools is illustrated schematically in FIG. 1. Here, a suitable pressure-fluid source, such as a source of variable air pressure is indicated at 22. This source couples appropriately through conduit structure 24 formed conventionally within stator 12 with what is referred to herein as a charge/discharge plenum 26 that is interposed the stator and rotor, with a rotary seal 28 provided for establishing or removing selectively a pressure-fluid seal between the stator and rotor.

Extending from plenum 26 into the rotor is a conduit structure 30 which couples (as is shown only schematically in FIG. 1) with a pilot-operated check valve, or valve structure, 32, the downstream side of which couples through conduit structure 34 with what is referred to herein as an action plenum 36. Plenum 36 couples through conduit structure shown schematically at 36 to the conventional pressure-fluid fittings provided for cells 18.

Figure 3:
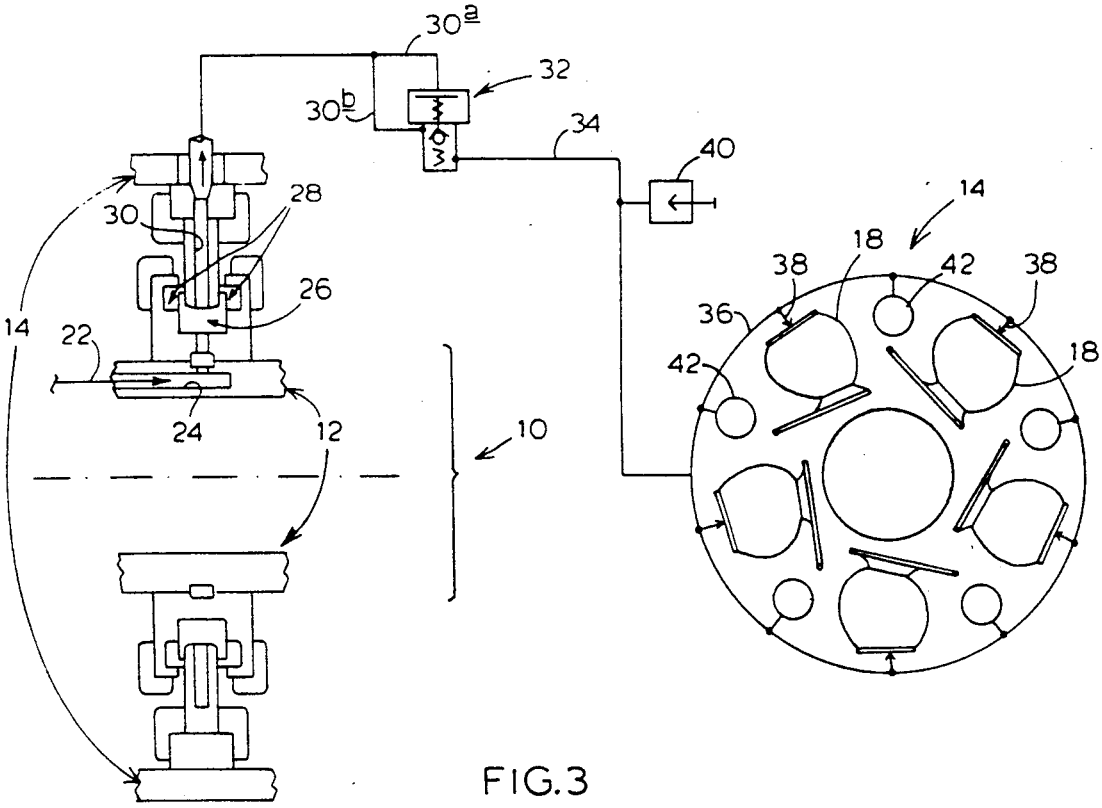
FIG. 3 is a fragmentary, schematic diagram further illustrating the features of the invention.

FIG. 3 shows in somewhat greater detail the various components illustrated schematically in FIG. 1. On the left side of this figure, visually held together by bracket 10 is fragmentary cross-sectional view taken through the stator and rotor in debarker 10, which structure are very similar in construction to those by the same general designation illustrated in U.S. Pat. No. 4,402,353. The reader is referred to the drawings and text in that patent, incorporated herein by reference, for a further understanding of how, basically, debarker 10 is constructed. Thus, on the left side of FIG. 3 there are shown fragments of rotor, or rotary ring, 14 suitably mounted, as through rotary bearing structure, on stator 12. Extending from the top of the left side of FIG. 3, and to the right thereof, is a schematic illustration of the pressure fluid supply structure of the present invention which couples ultimately to the air cells that are carried on ring 14. These cells on ring 14, and the fluid system coupled to them are illustrated schematically on the right side of FIG. 3.

Source 22 feeds into the stator via previously mentioned conduit structure 24 which couples to previously mentioned charge/discharge plenum 26. Plenum 26 extends substantially as an annular space distributed in the rotary interface between the stator and rotor.

Interposed the rotor and stator in the vicinity of plenum 26 is structure which acts as previously mentioned air seal 28. Reference to the '353 patent mentioned above will further explain the mechanics of the construction of this seal structure.

Extending from plenum 26 into rotor 14 is conduit structure 30 which connects with the input side of pilot-operated check valve 32. A branch **30*a* of conduit structure 30 feeds the pilot side of the valve, and a branch 30*b* feeds the main-flow side of the valve. Downstream from valve 32 relative to source 22 conduit structure 34 extends to action plenum 36 which takes the form of a suitable annular passage, or chamber, formed in and extending around rotor 14. Plenum 36 couples to cells 18 via conduit structures 38 which take the form of individual fluid connectors between plenum 36** and the cells.

Included in what is shown in FIG. 3, though not required necessarily by the present invention, are a manually operated bleeder valve 40 which is mounted on the rotor and coupled to conduit structure 34. Also provided are plural pressure accumulators, such as those shown at 42, which are coupled to plenum 36. The manual bleed valve allows for manual bleeding of the pressure-fluid system which is disposed downstream from valve 32, under circumstances with rotor 14 stopped. Accumulators 42 act to evenize operating pressure under circumstance with valve 32 closed and cells 18 pressurized for use. More particularly, the accumulators function to minimize peaks and valleys in operating pressure resulting from contracting and expanding of the air cells as the debarking tools engage and work upon a log.

When it is desired to prepare barker 10 for operation, a suitable tool-operating force is determined and a required operating pressure chosen. Source 22 is suitably manipulated to supply pressure fluid into the system properly to inflate the air cells. Pressurization of the system causes seal 28 to seal between the rotor and stator in the debarker, cracks open valve 32, and inflates the air cells to the desired operating pressure. Quick cut-off of source pressure causes valve 32 to close and to lock (check) the appropriate operating pressure on the downstream side of the valve. Such also causes seal 28 to depressurize and to relax in the interface between the rotor and stator.

The rotor may now be operated at any suitable and desired operating speed, including the maximum operating speed capable of being produced by the debarker. In this mode of operation, tool actuation is substantially solely under the control of the air cells. Inertial forces are minimized by virtue of the fact that the structure carried on the rotor, and particularly the air-cell structure, is quite lightweight in nature. In addition, no seal water is experienced inasmuch as the seal is nonpressurized and relaxed.

If it is desired to change the operating pressure of the system on the fly, source 22 is repressurized to a level enabling cracking open of valve 32, and the source pressure is then either increased or slowly decreased until a new desired operating pressure is achieved, whereupon it is again quickly cut off to reseal the downstream side of valve 32 for continued air-cell controlled operation. During this adjustment of pressure, seal 28 once again becomes pressurized to allow the repressurizing operation to occur, but is relaxed quickly thereafter so that only minimum wear occurs. Obviously, such an operation can be employed on the fly to relax the pressure in the system sufficiently to return the debarking tools to fully open conditions. During this mode when the seal is pressurized tool actuation is under the combined control of the air cells and the instantaneous pressure being supplied thereto by the external source.

Another implementation of this second (air-seal-active) mode of operation is one wherein the seal is maintained pressurized during a debarking operation in order to allow an operator continuously or as desired to modify tool actuation pressure in response to particular log-debarking requirements.

Plenum 26 is referred to as a charge/discharge plenum, since it is through this space that the air cells are charged and discharged under normal operating circumstances. Action plenum 36 is given its name to reflect that pressure in this space is always active upon the air cells.

The advantages thus offered by the dual-operating-mode debarker just described should be very apparent. The high-speed, low-inertia capability of air-cell machines is available without the attendant drawback that a machine must be stopped in order to modify air-cell pressure. The on-the-fly pressure change capability of air-seal machines is offered without an attendant downside drawback of costly air-seal wear.

While a preferred embodiment of the invention has been described herein, those skilled in the art will certainly recognize that variations and modifications may be made without departing from the spirit of the invention. For example, a valve other than strictly a simple pilot-operated check valve could be used at the location of valve 32. For example, this valve could also be a normally close two-way pilot-operated valve. Other valves usable for the intended purpose in the invention can also be employed. All such modifications are expected to come within the scope of the following claims.

It is desired to claim and secure by Letters Patent:

1. A stator/rotary-ring log debarker with ring-mounted log-engaging tools comprising inflatable/deflatable, pressure-fluid-operated motor means drivingly connected to said tools for actuating the same, and dual-operating-mode, pressure-fluid supply structure operatively interposed said motor means and a suitable external pressure-fluid source, operable in one mode with tool actuation occurring solely under the control of said motor means with the motor means pressure-isolated from such a source, and in another mode with tool actuation under the combined control of said motor means and such a source with the motor means pressure-connected to the source.

2. The debarker of claim 1, wherein said supply structure includes a pressure-fluid seal interposed the stator and the rotary ring, and valve structure interposed said seal and said motor means, said seal being nonpressurized and said valve structure being closed during said one operating mode, and said seal being pressurized and said valve structure being open during said other operating mode.

3. The debarker of claim 2, wherein said supply structure further includes a charge/discharge plenum bridging the stator and the rotary ring sealable by said seal, a pilot-operated-like check valve forming said valve structure, and an action plenum interposed said valve and said motor means sealable therebetween by said valve.

4. The debarker of claims 1, 2 or 3, wherein said motor means for each tool takes the form of a pressure-fluid bag.

* * * * *